United States Patent [19]

Sucheski et al.

[11] 4,043,034

[45] Aug. 23, 1977

[54] METHOD AND APPARATUS FOR CONNECTING CONDUCTORS TO TERMINALS IN CONNECTORS

[75] Inventors: Matthew Michael Sucheski, Harrisburg; Earl William Wagner, Annville, both of Pa.

[73] Assignee: AMP Incorporated, Harrisburg, Pa.

[21] Appl. No.: 679,961

[22] Filed: Apr. 26, 1976

[51] Int. Cl.[2] ..... H01R 43/00

[52] U.S. Cl. ..... 29/749; 29/628

[58] Field of Search ..... 29/203 B, 203 MW, 625, 29/626, 628, 630 A, 749, 754

[56] References Cited

U.S. PATENT DOCUMENTS

| | | | |
|---|---|---|---|
| 3,032,860 | 5/1962 | Andren | 29/628 |
| 3,804,130 | 4/1974 | Tarbox et al. | 29/203 B |

*Primary Examiner*—Lowell A. Larson

*Attorney, Agent, or Firm*—Frederick W. Raring; Robert W. Pitts; Jay L. Seitchik

[57] ABSTRACT

A method and apparatus is disclosed for producing electrical harness assemblies and sub-assemblies of the type comprising at least one multi-contact electrical connector and wires secured to, and extending from, the terminals in the connector. The apparatus comprises an insertion zone through which the wires are fed and in which the wires are severed. Electrical connectors are fed into the insertion zone and positioned in alignment with the severed ends of the wires. The wires are connected to the terminals in the connector by moving the connectors laterally towards the wires and, at the same time, moving an insertion tool towards the wires and towards the connector to push the wires into the terminals in the connector. The wire feed means is programmable to permit selective feeding of the wires and/or the feeding of different wire lengths during each operating cycle so that a variety of types of harness assemblies and subassemblies can be produced.

14 Claims, 21 Drawing Figures

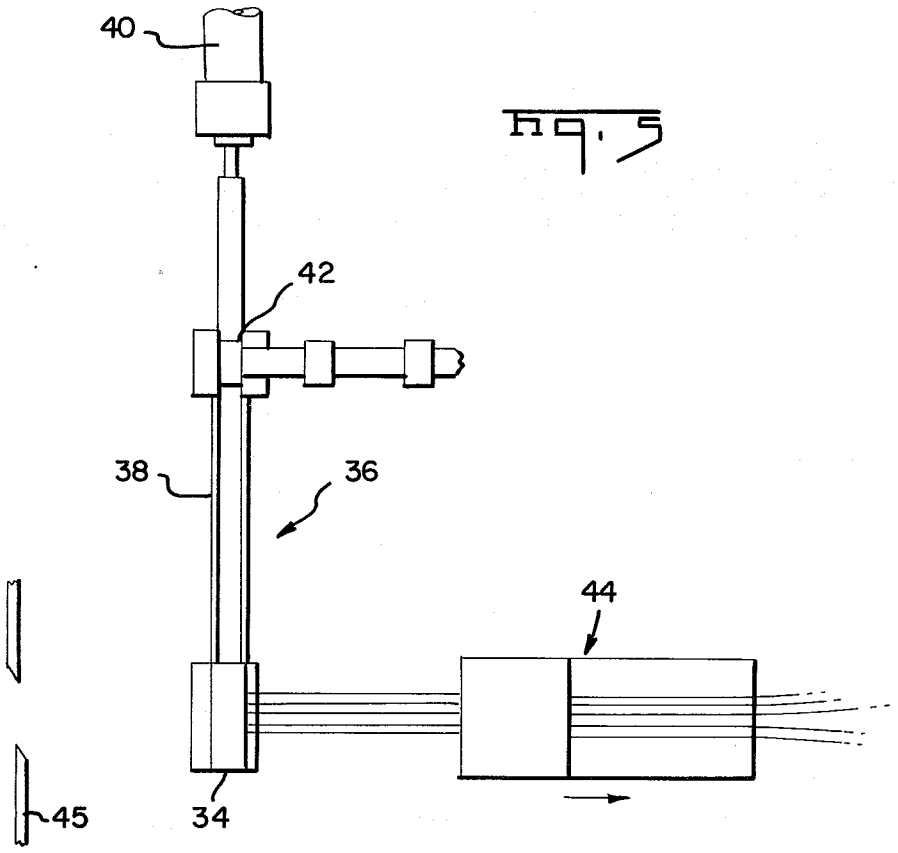
Fig. 5
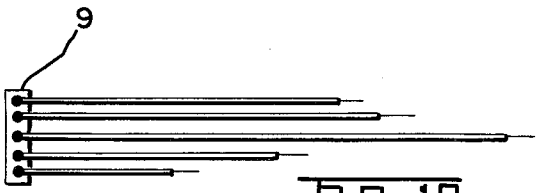
Fig. 19
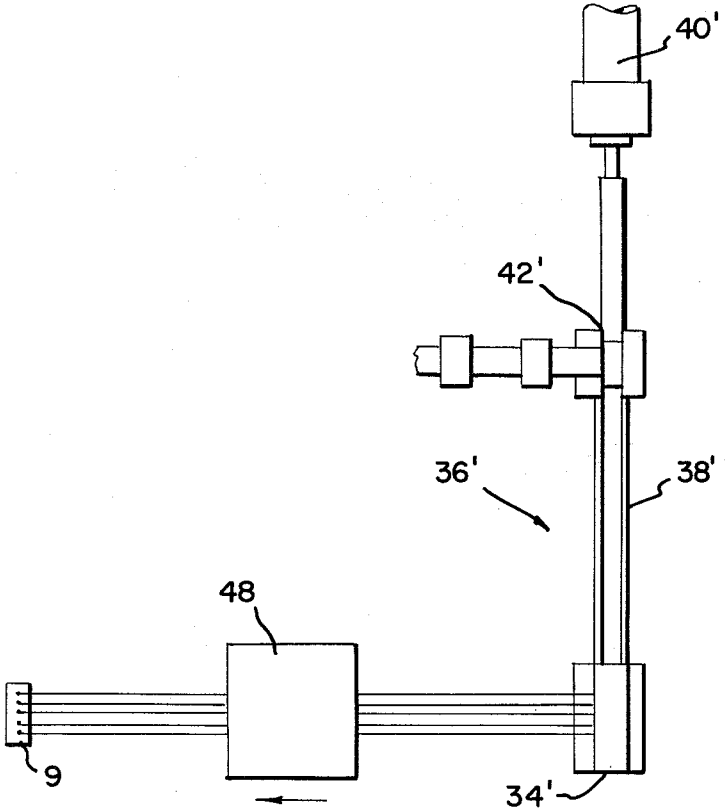
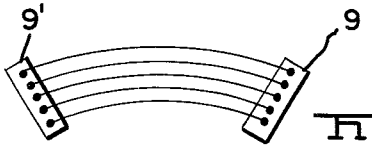
Fig. 10

16

48
200
206
207
204
202
16
215
214
221
222
226
224
220
228
216
237
236
238
240
242
264
266
262
244
250
246
248

METHOD AND APPARATUS FOR CONNECTING CONDUCTORS TO TERMINALS IN CONNECTORS

BACKGROUND OF THE INVENTION

This invention relates to a method and apparatus for producing electrical harness assemblies and harness subassemblies of the type comprising, for example, one or two electrical connectors and wires extending from, and connected to, the terminals in the connector or connectors. The herein disclosed apparatus embodiment of the invention is capable of producing either of the types of harness assemblies described above, however, it will be apparent to those skilled in the harness making arts that the principles of the invention can be used in a wide variety of harness manufacturing operations to manufacture harnesses which are significantly more complex than those disclosed herein.

A commonly used type of multi-contact electrical connector comprises an insulating housing having a plurality of contact terminals therein, each terminal having a wire receiving portion which is adapted to receive, and establish electrical contact with, an electrical conductor upon movement of the conductor laterally of its axis and into the conductor receiving portion. Connectors of this type are shown, for example, in U.S. Pat. No. 3,760,335 and in FIG. 1 of application Ser. No. 657,138 filed Feb. 11, 1976, the former type of connector being widely used in the communications industry and the later type being used in the appliance and television industries. A wide variety of types of apparatus have been developed for inserting wires into these type of connecting devices, as evidenced by U.S. Pat. No. 3,758,935, 3,766,622, and the above identified application Ser. No. 657,138.

The instant invention is directed to the achievement of methods and apparatus for producing electrical harnesses and harness subassemblies, the harnesses including connectors of the general type described above. The invention is specifically directed to the achievement of an apparatus which can be operated at high production rates and which is capable of producing, with minor adjustments or changes, a variety of types of harness assemblies and subassemblies. For example, a harness assembly comprising two connectors and a plurality of wires connected to the terminals in the connectors and extending between the connectors can be manufactured by a fully automatic machine constructed in accordance with the principle of the invention. The wires may all be of the same length or the lengths may be graduated from one end of each connector to the other end if the assembly is to be used under circumstances where the wires will be in side by side parallel relationship and follow a curved path. The principles of the invention can be also employed to produce a subassembly comprising a single multi-contact connector having wires connected to, and extending from, the terminals therein. The wires may be of different predetermined lengths, if desired, and the ends of the wires can be stripped of their insulation if required.

A preferred apparatus embodiment of the invention comprises a wire feeding means for feeding a plurality of wires in side-by-side parallel relationship through, and beyond, a wire insertion zone. The wire feeding means is programmable and has a separate pressure roll for each wire, an arrangement which permits varying predetermined length of the individual wires to be fed during each operating cycle. The connectors are fed into the insertion zone and positioned in side-by-side relationship in spaced relationship to the wires with the wire receiving portions of the terminals in alignment with the previously fed wires. The apparatus has means for cutting the wires in a plane which extends between the two connectors and moving the cut ends away from each other so that the ends of the wires are in precise alignment with the wire receiving portions of the terminals. Insertion of the wires into the wire receiving portions is accompanied by moving the connectors towards the wires and, at the same time, moving insertion tool members towards the wires and towards the connectors so that the wires move relatively into the wire receiving portions of the connectors although the wires themselves do not move in an absolute sense.

A connector is thus applied to the trailing ends of the cut wires and to the leading ends of the wires extending from the feed means during each cycle. During the next succeeding cycle the operation is repeated and a harness assembly comprising two connectors and wires extending between the connectors is produced. A subassembly comprising only a single connector having wires extending from its terminals can be manufactured by simply deactivating one of the connector feed mechanisms.

It is accordingly an object of the invention to provide an improved method and apparatus for the manufacture of electrical harness assemblies and subassemblies. A further object is to provide a method apparatus which can be used to produce a variety of types of harness assemblies and subassemblies. A still further object is to provide a method and apparatus which can be used in the manufacture of relatively complex electrical harnesses having a variety of types of connectors therein and having conductors of varying lengths and types extending selectively between the terminals in the connectors. A further object is to provide a method and apparatus capable of producing harness assemblies and subassemblies at a high rate of production.

These and other objects of the invention are achieved in preferred embodiments thereof which are briefly described in the foregoing abstract, which are described in detail below, and which are shown in the accompanying drawing in which:

FIG. 3 is a diagramatic plan view of an apparatus in accordance with the invention, this view showing the positions of the parts immediately after feeding of the wire through the apparatus and prior to cutting of the wires.

FIGS. 4 and 5 are views similar to FIG. 3 showing the positions of the parts at different stages of the operating cycle.

Figure 6:
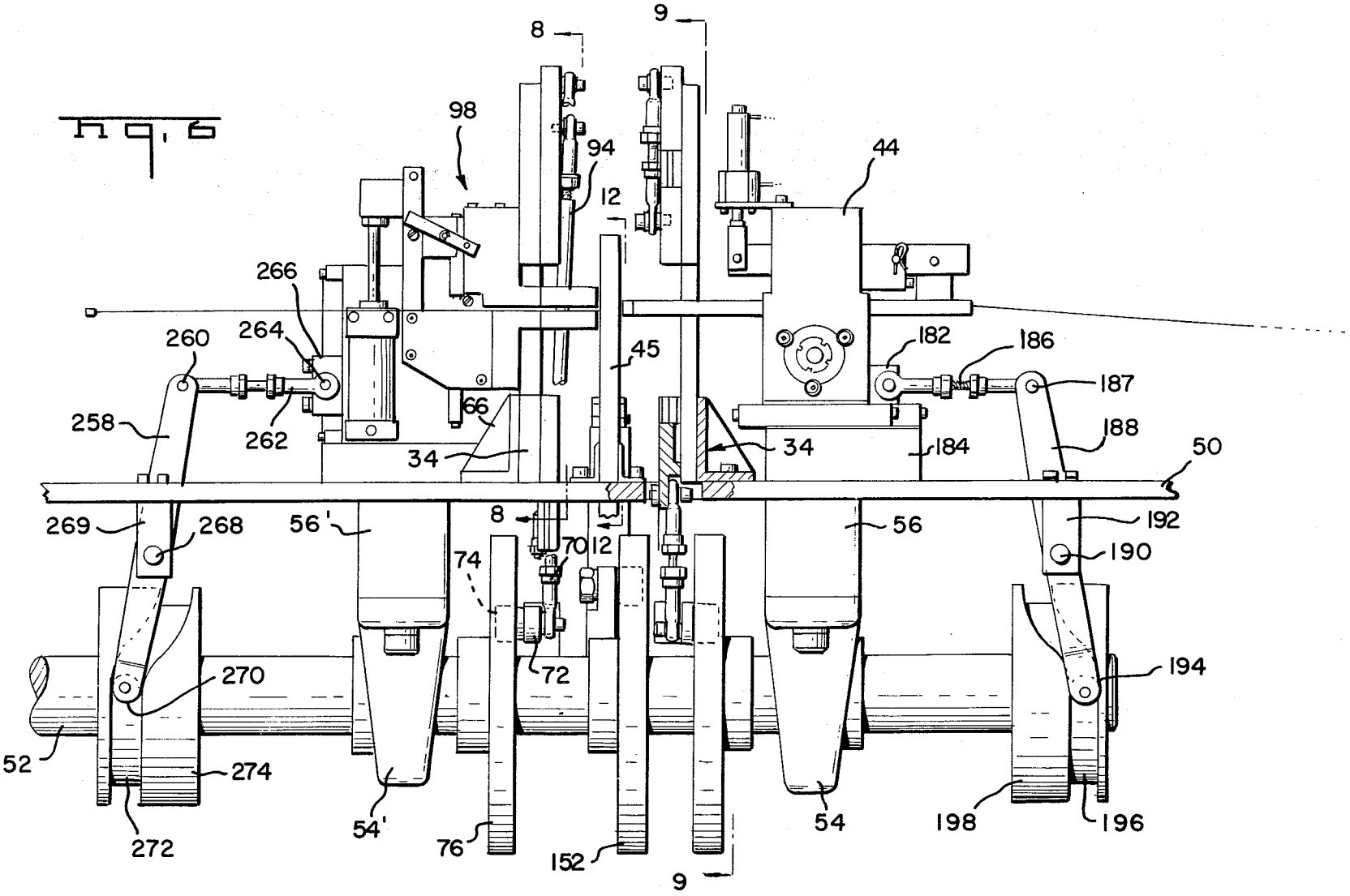
FIG. 6 is a frontal view of an apparatus in accordance with the invention.
Figure 6A:
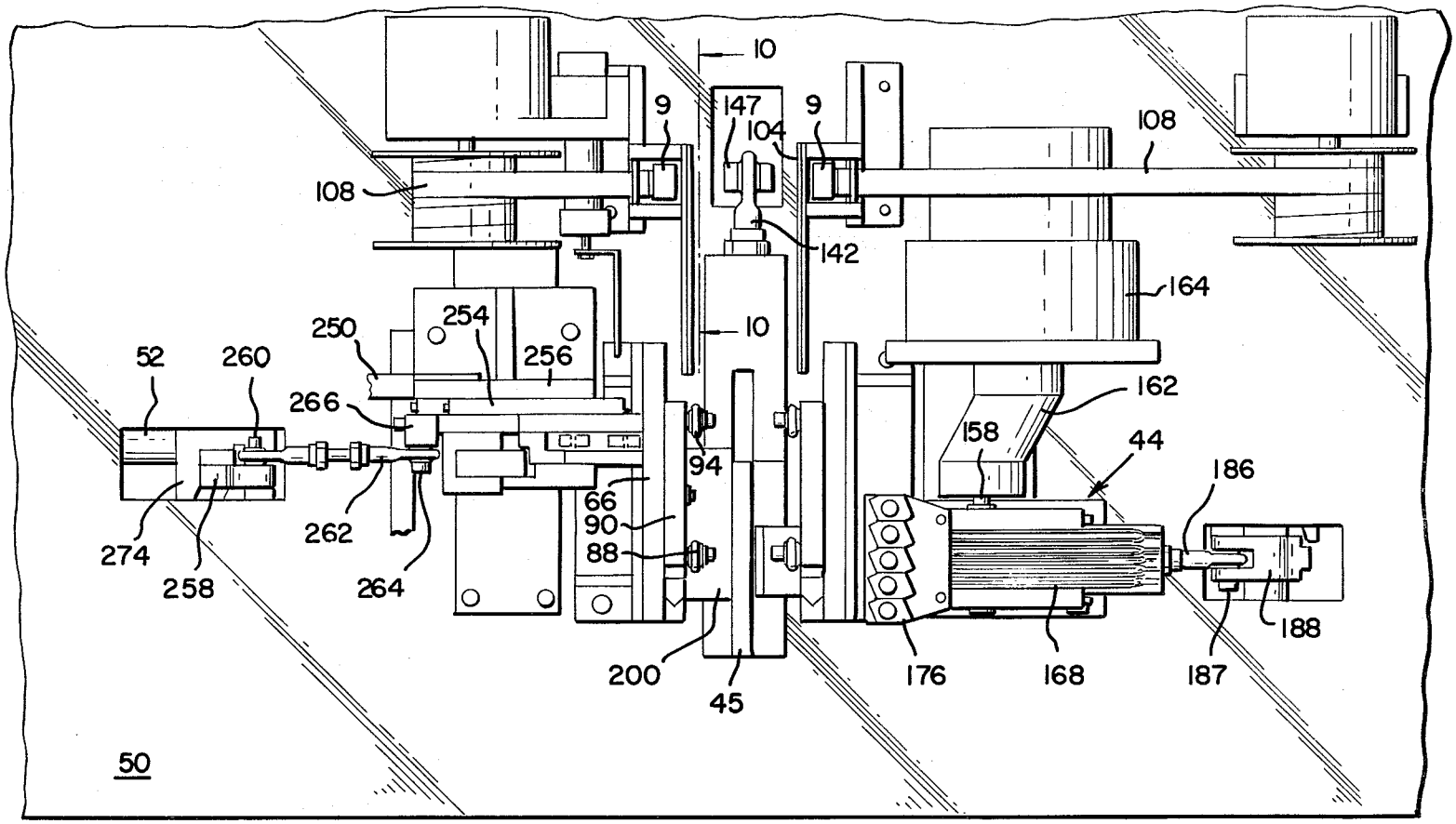
Figure 8:
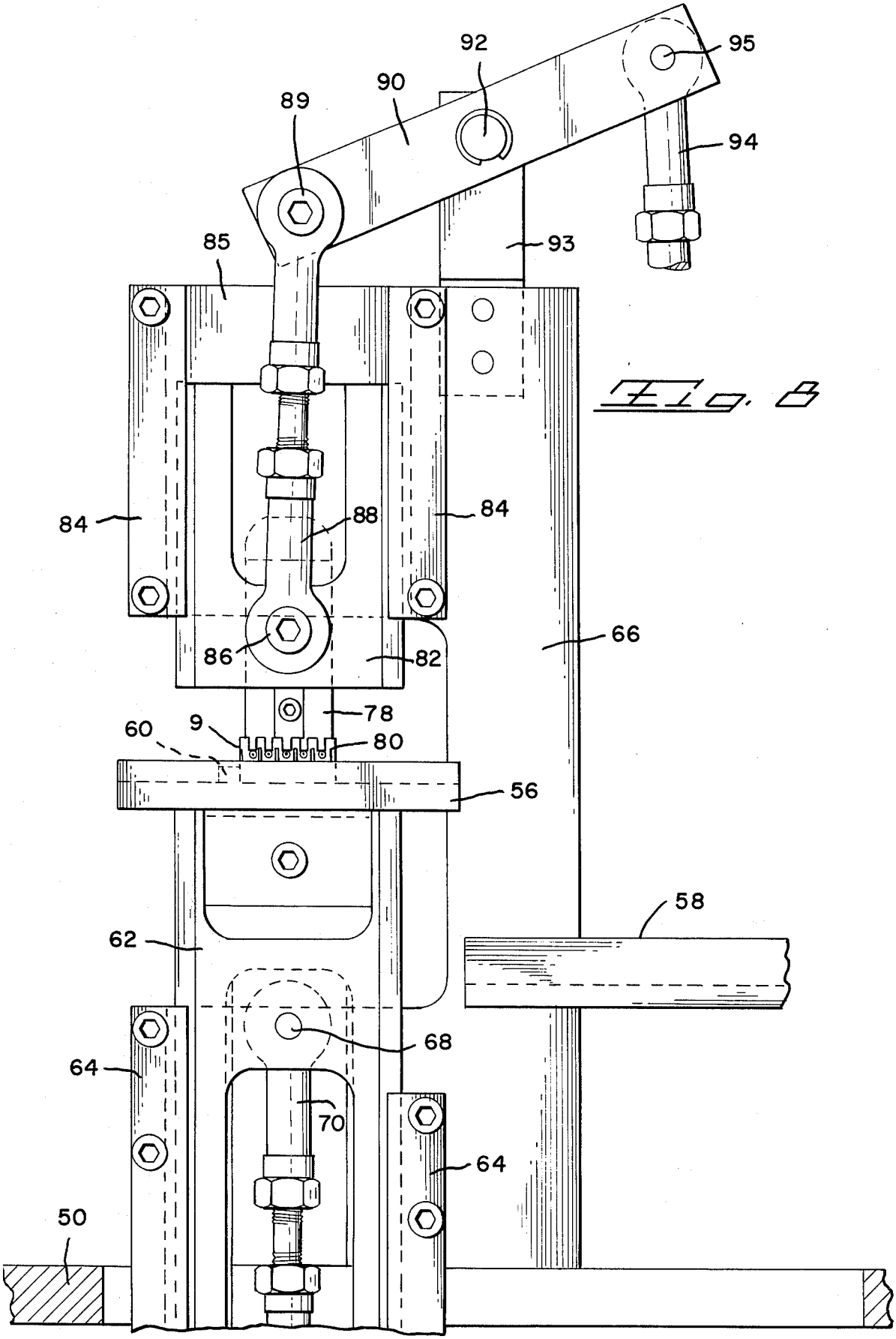
Figure 9:
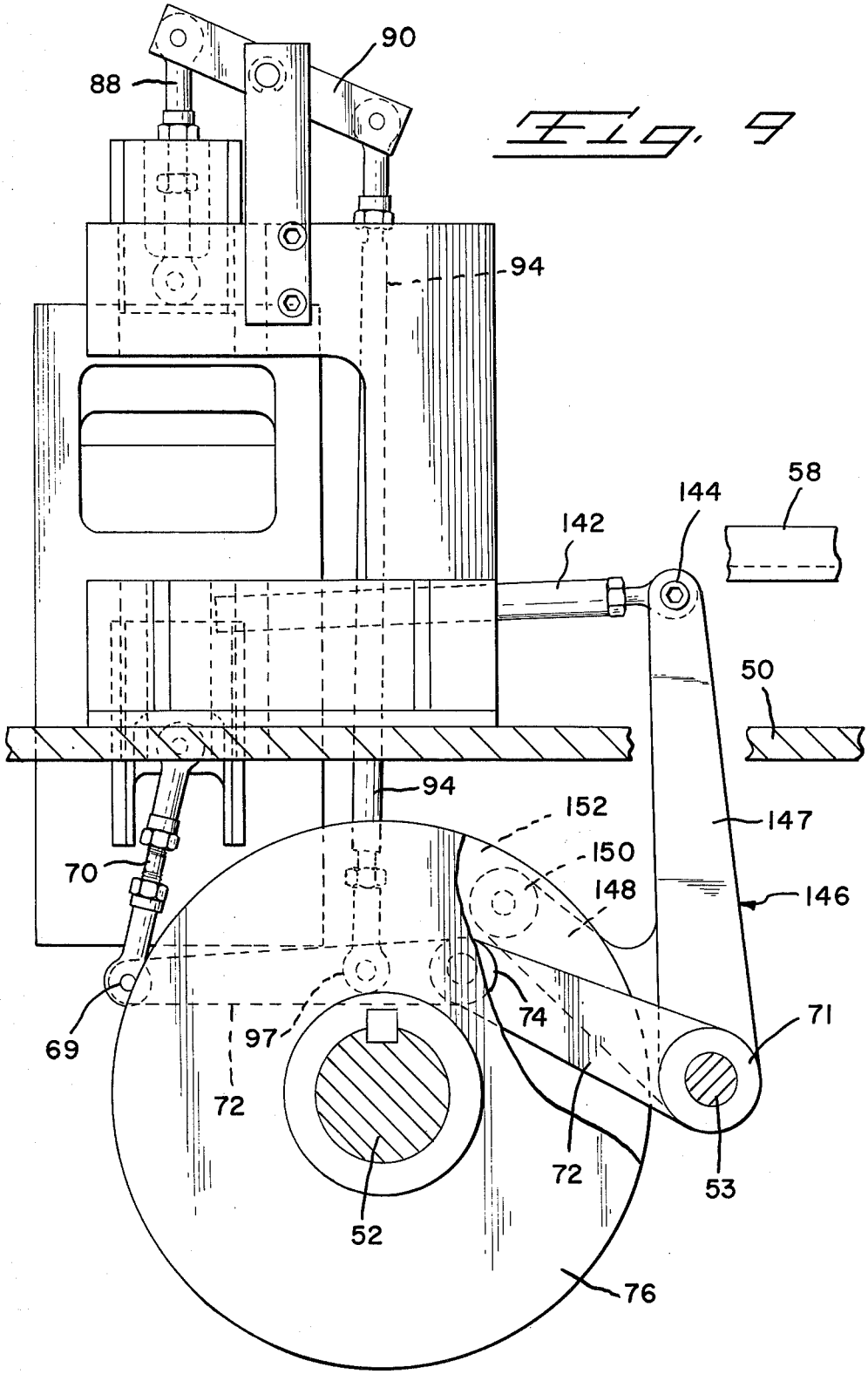

FIGS. 8 and 9 are views taken along the lines 8—8 and 9—9 of FIG. 6.

Figure 7:
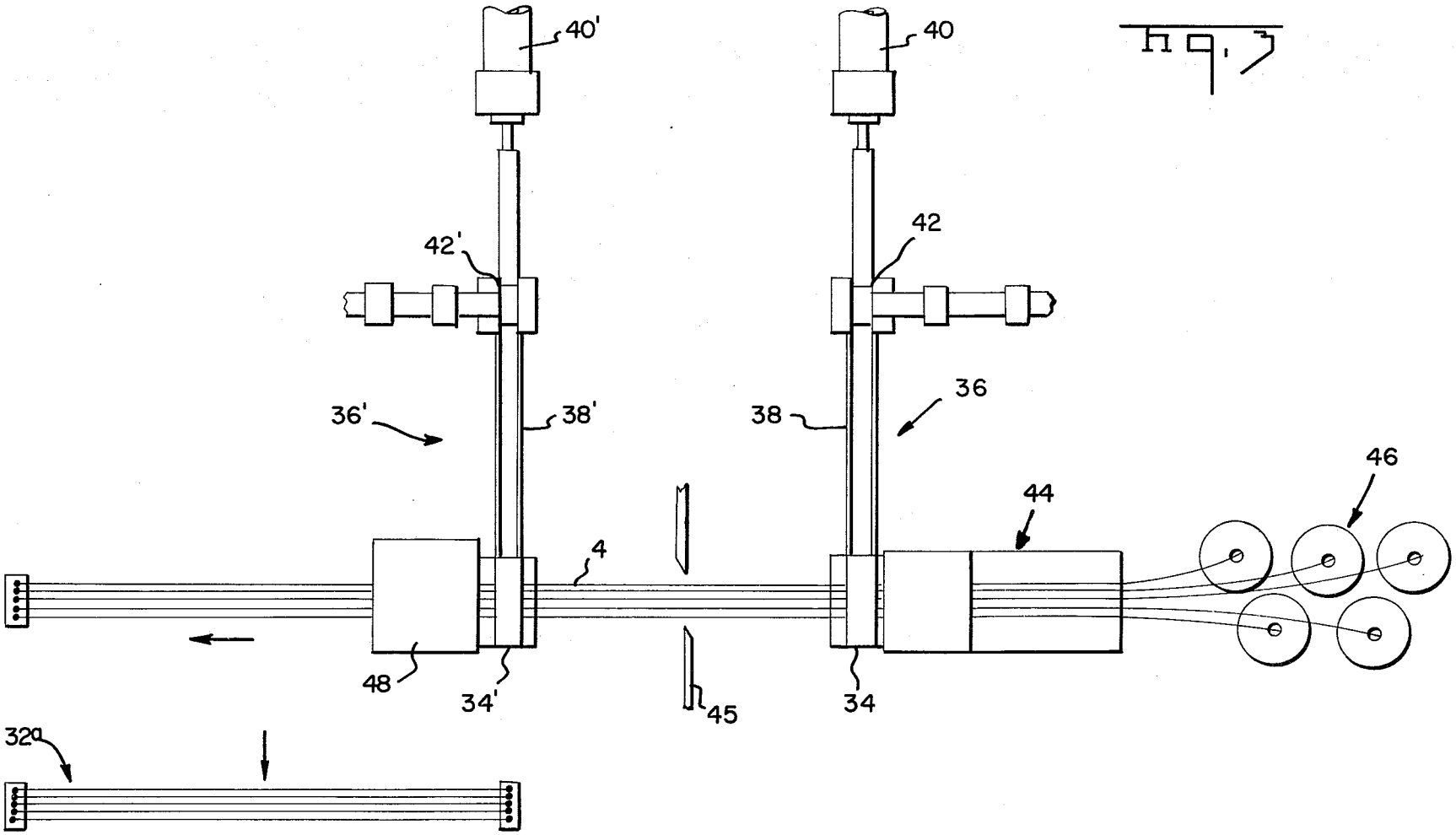
FIG. 7 is a top plan view of the apparatus.
Figure 10:
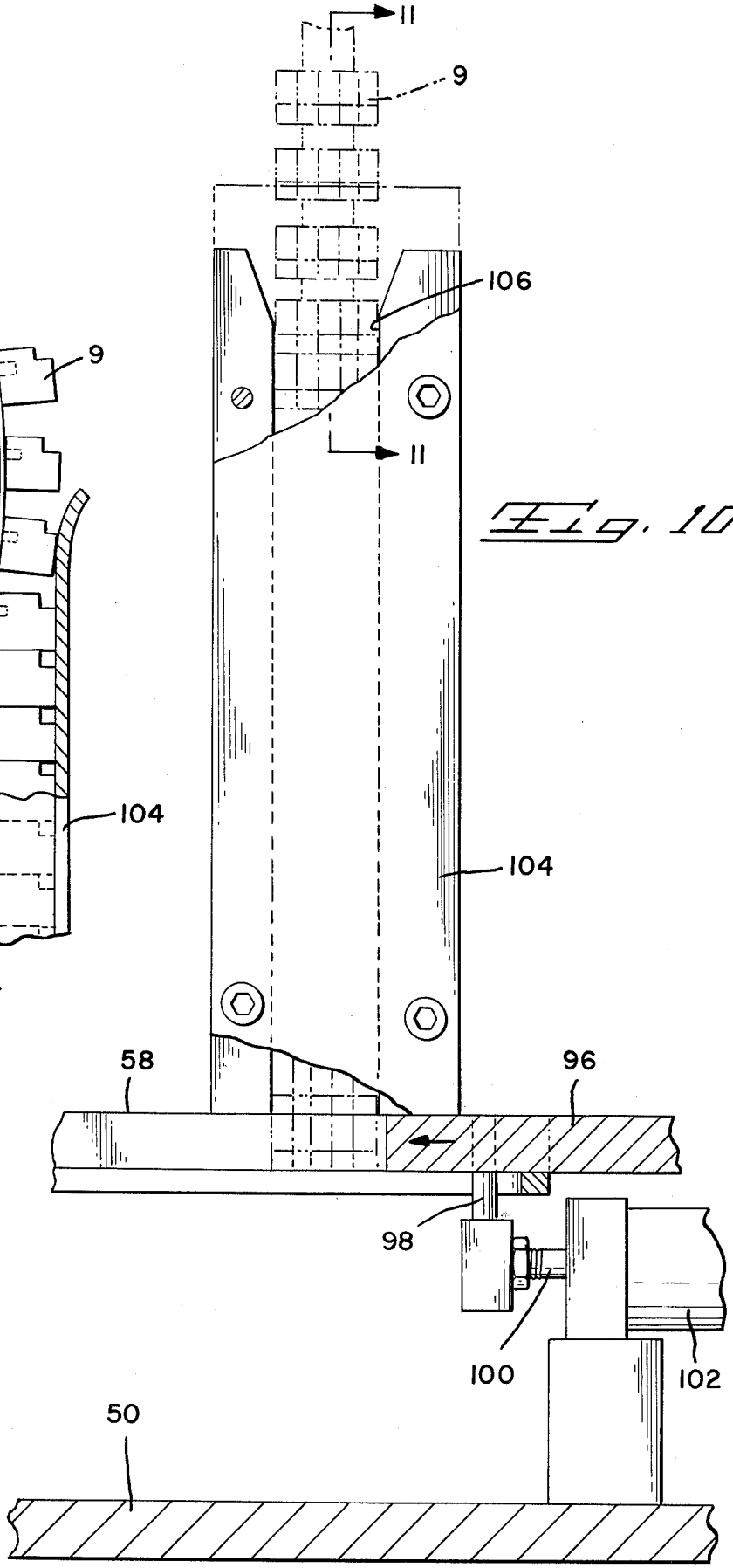

FIG. 10 is a view taken along the lines 10—10 of FIG. 7.

Figure 11:
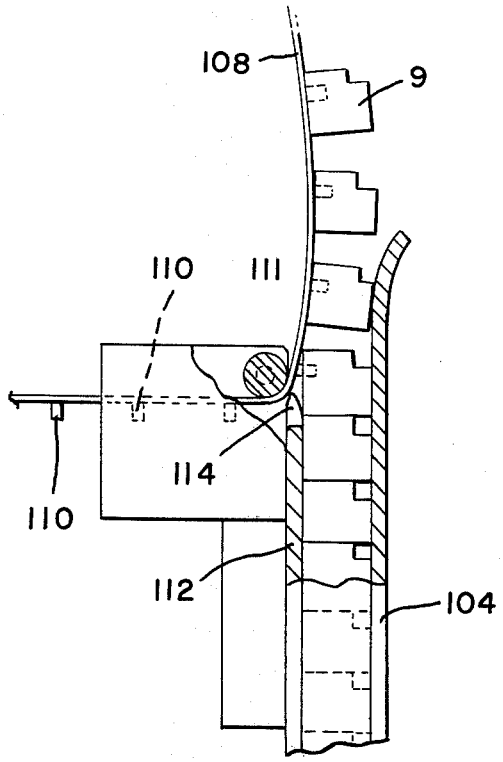

FIG. 11 is a view taken along the lines 11—11 of FIG. 10.

Figure 12:
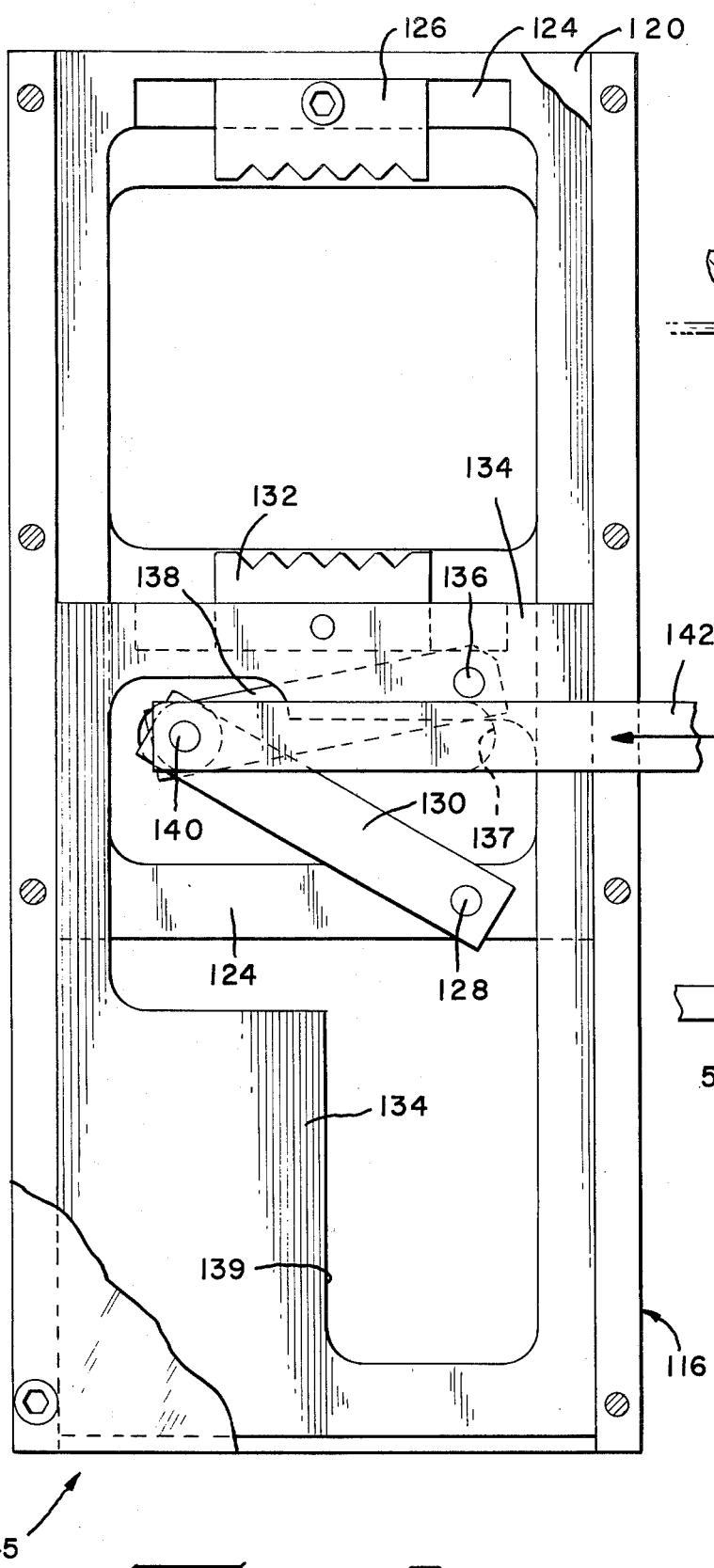

FIG. 12 is a view taken along the lines 12—12 of FIG. 6, showing the wire shearing mechanism with the shearing blades in their open position.

Figure 13:
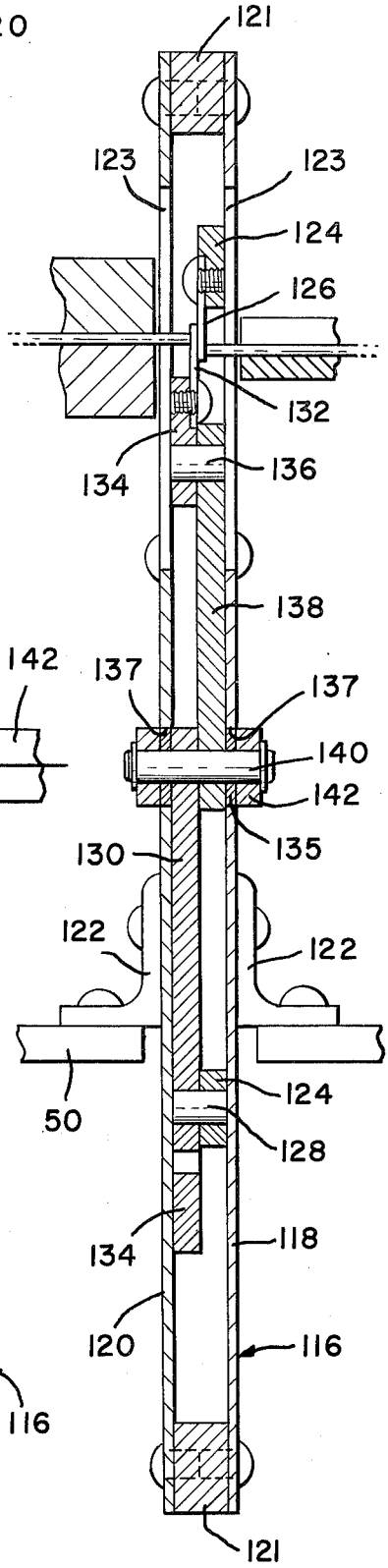

FIG. 13 is a cross-sectional view of the shearing mechanism showing the positions of the parts when the shearing blades are their closed positions.

Figures 14, 14A:
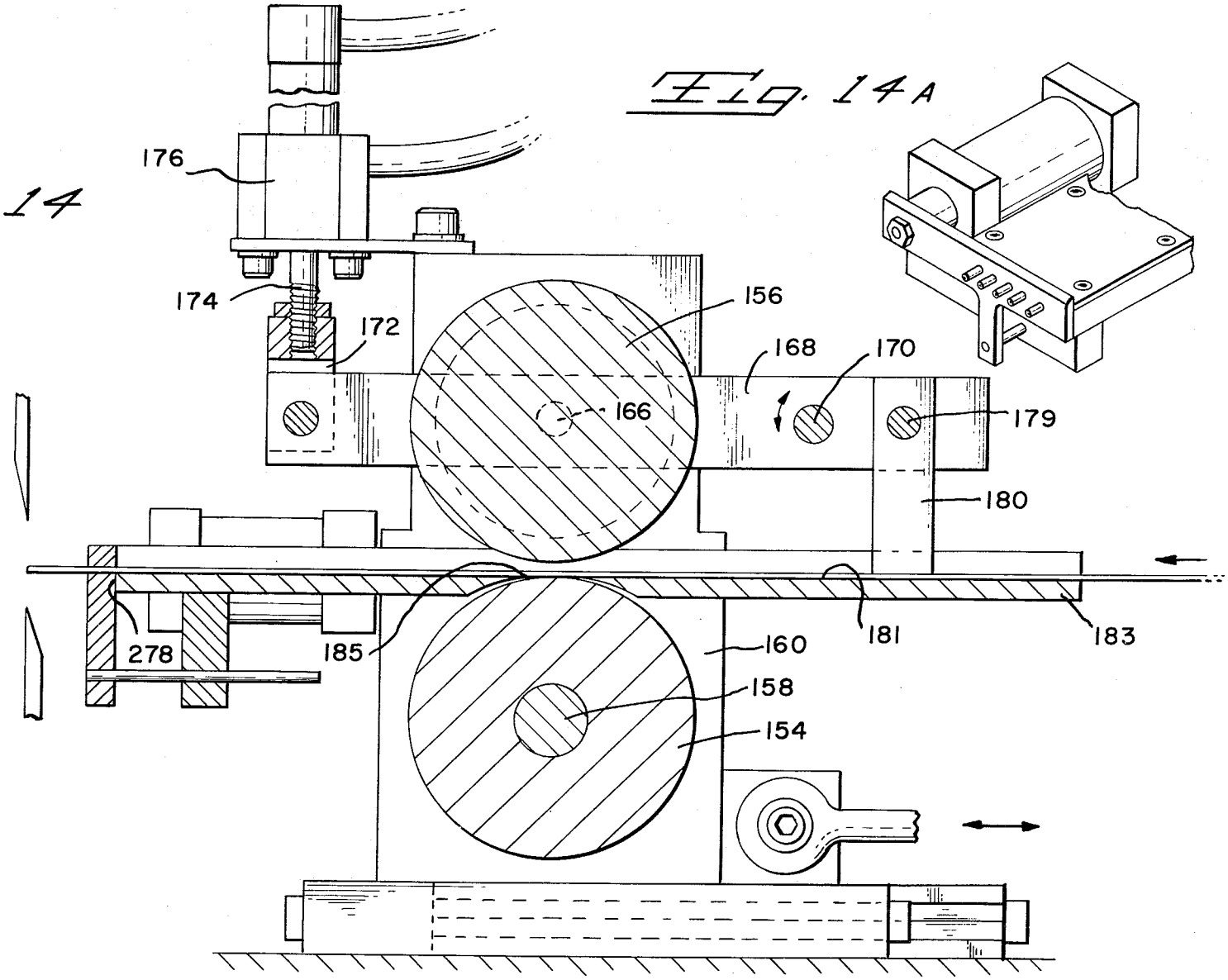

FIG. 14 is a sectional side view of the wire feed mechanism.

FIG. 14A is a fragmentary perspective view of a wire aligning means which is mounted on the wire feed mechanism.

Figure 15:
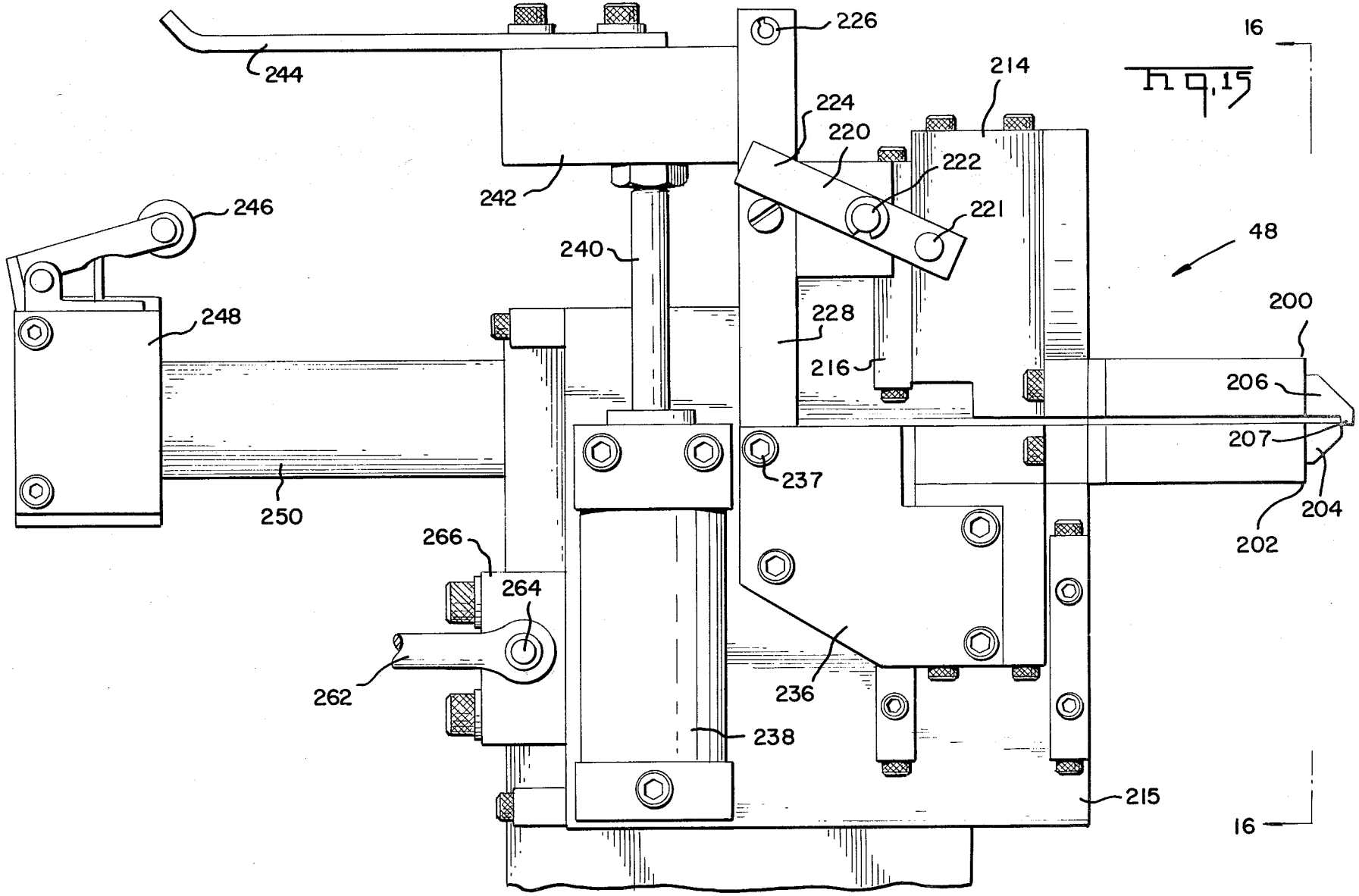

FIG. 15 is an enlarged frontal view of the lefthand slidable jaw mechanism of the apparatus.

Figure 16:
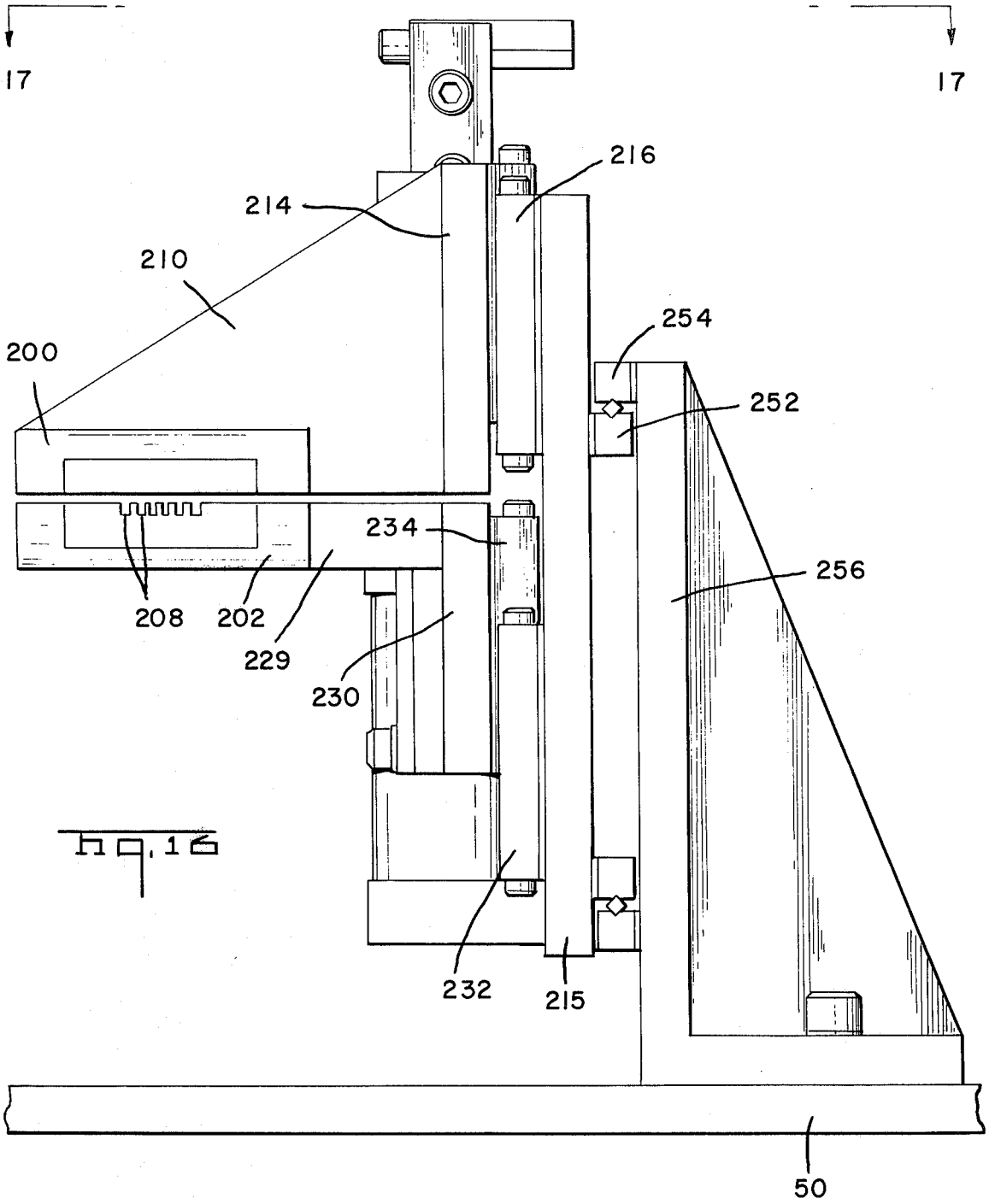

FIG. 16 is a frontal view of the lefthand jaw mechanism this view being taken along the lines 16—16 of FIG. 15.

Figure 17:
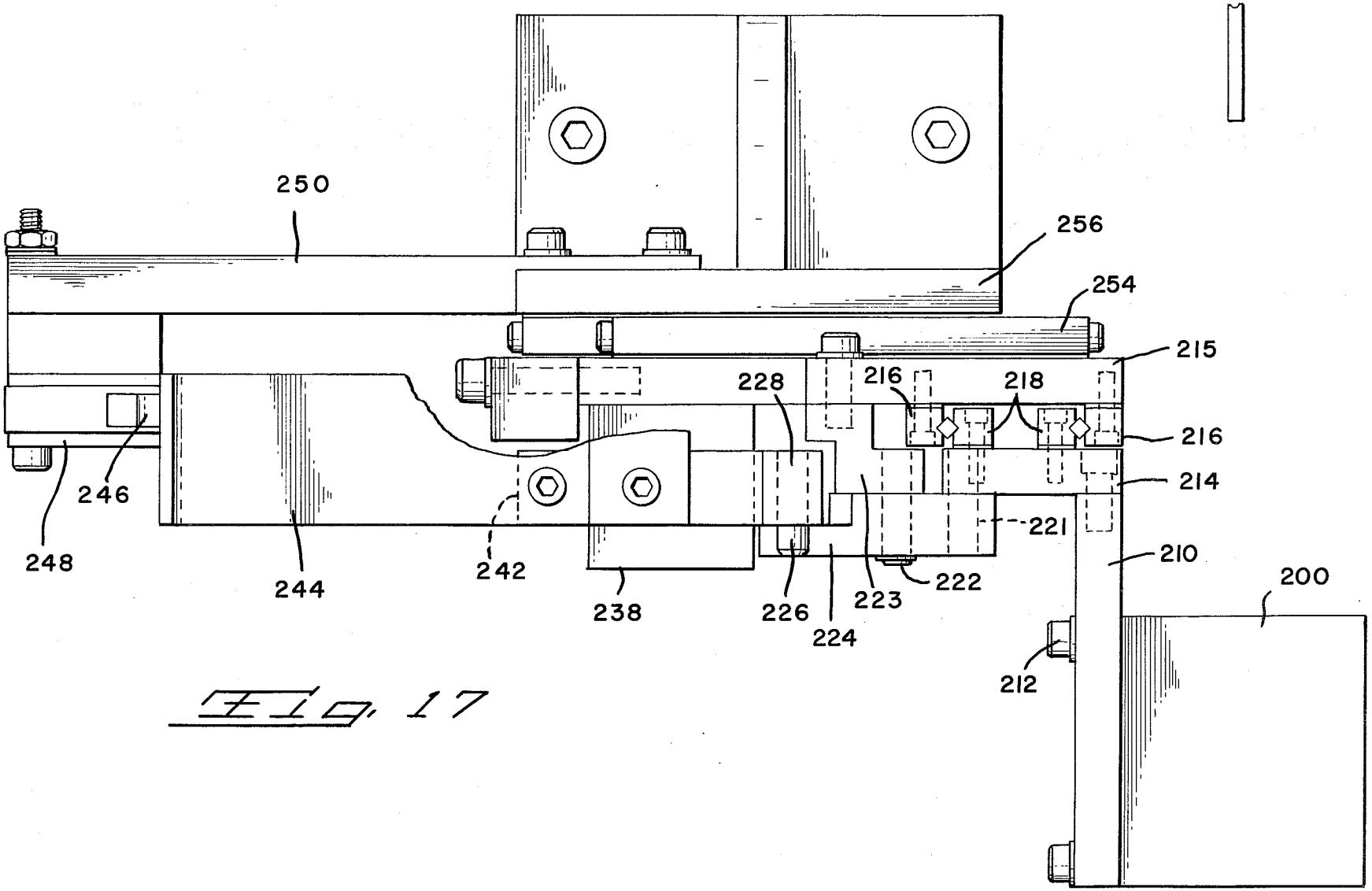

FIG. 17 is a top plan view of the jaw mechanisms taken along the lines 17—17 of FIG. 16.

FIGS. 18 and 19 are plan views of additional type of harness assemblies and subassemblies which can be produced by the method and apparatus of the invention.

Figure 1:
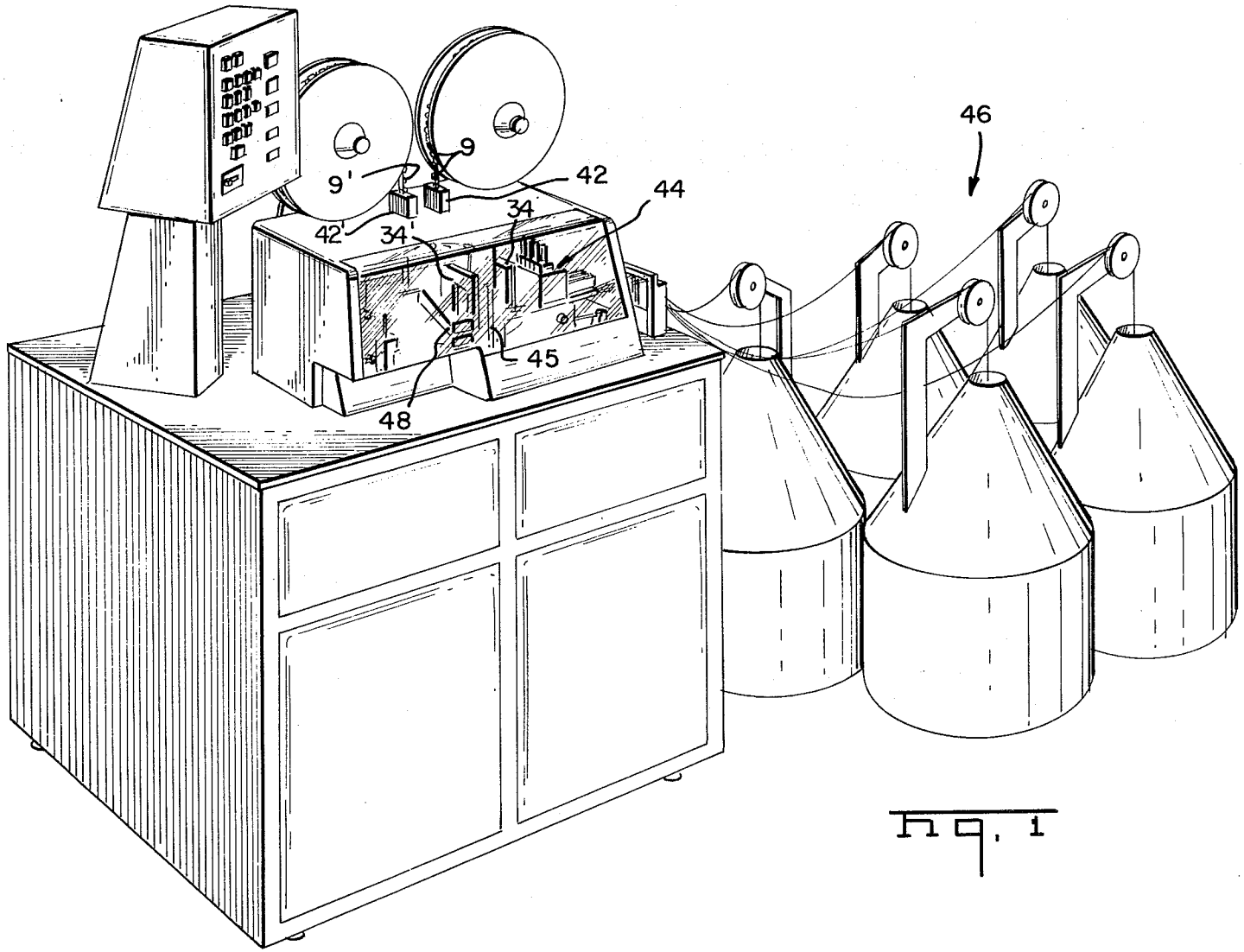
FIG. 1 is a perspective view of a preferred form of apparatus in accordance with the invention.
Figure 2:
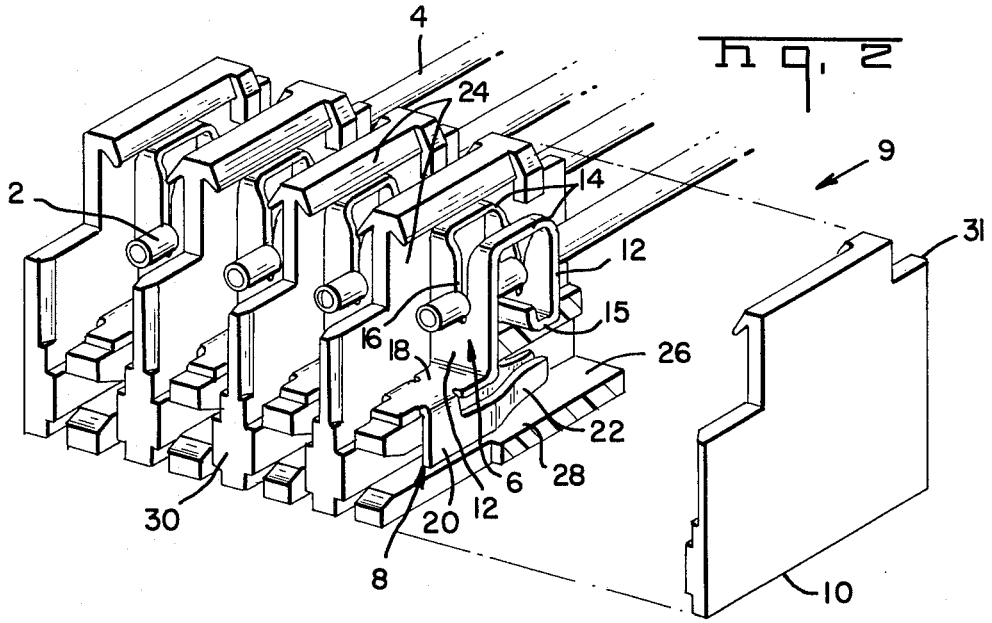
FIG. 2 is a perspective view of an electrical connector of a type which can be used in the harness of FIG. 1.
Figure 1A:
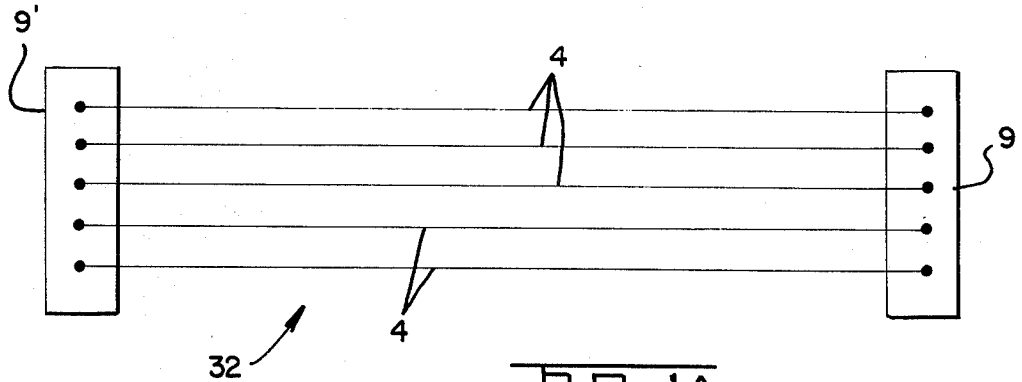
FIG. 1A is a plan view of one type of relatively simple electrical harness which can be produced by the apparatus and method of the invention.

FIG. 1A shows a relatively simple type of electrical harness which can be produced by the method and apparatus of the invention which comprises two multicontact electrical connectors 9, 9′ and wires 4 which have their ends connected to the terminals in the connectors so that corresponding terminals in the two connectors are electrically connected to each other. The terminals in the connectors have wire receiving portions 6 which receive the ends 2 of the wires 4 as shown in FIG. 2.

Each terminal 8 has a pair of spaced apart plate-like sections 12 which are connected at their upper ends by strap members 14 and which are provided with aligned slots 16 for reception of the wires. The slots have a width which is less than the diameter of the conducting core of a wire so that upon insertion, the edges of the slot will penetrate the insulation of the wire and establish electrical contact with the conducting core. In the disclosed embodiment, the rearward plate section 12 has a reversely extending arm 15 integral therewith which bears against the front plate section for stregthening purposes. This front plate section has a forwardly extending tongue 18 from the edges of which there extend depending arms 20. Contact springs 22 extend from these arms beneath the wire receiving portion 16, these contact springs being adapted to receive a terminal post in a printed circuit board or the like.

The housing 10 of the connector is generally prismatic and has spaced apart barrier walls 24 on its upper side between which the wire receiving portions 6 of the terminals are mounted. The upper side is recessed as shown at 26 and the wire receiving portions 6 and tongues 18 are contained in these recesses. The contact springs 22 extend through aligned openings or passageways 28 which extend through the housing from the oppositely directed sides 30 31 thereof. As shown in FIG. 1, the wires 4 extend towards the side 31 of the housing and each wire extends between an adjacent pair of barrier walls 24 with the end of the wire disposed in the wire receiving slots of the terminal.

Figure 4:
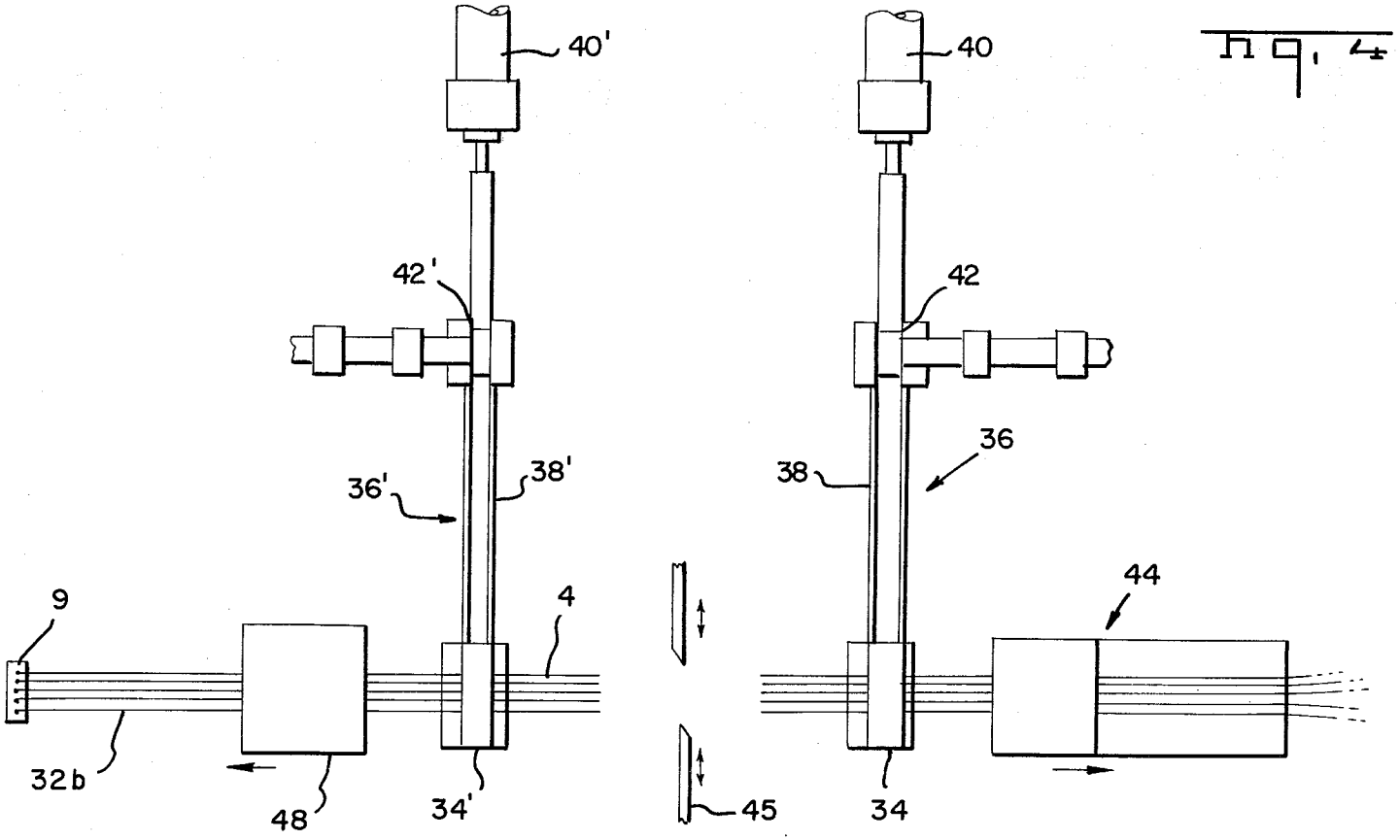

The general principles of the invention can be appreciated from an inspection of FIGS. 3-5 which show diagramatically the essential mechanisms of the apparatus and illustrate the method of producing the harness of FIG. 1. The apparatus has a wire insertion zone which is defined by a pair of spaced apart wire insertion stations 34, 34′. Connector holding means at provided at each of these stations to support and locate an electrical connector 9 in alignment with the wires 4 which have been fed through the insertion zone. The connectors are fed to the insertion zones by connector feed means 36, 36′ each of which comprises a feed track 38, a feed slide and a piston cylinder 40. The connectors are supplied from magazines 42 to feed tracks and advanced to the insertion zones by the feed slides. The wires are fed by a wire feed mechanism 44 from endless sources such as reels 46 past both of the insertion stations and through a movable jaw 48. The wires are cut by cutting means 45 in a plane which extends between the insertion stations 34, 34′ and the wires are clamped in the wire feed mechanism and the jaw 48. After cutting of the wires, the feed means 44 (which also serves as wire clamp) and the jaw 48 more relatively away from each other to position the cut ends of the wires in alignment with the terminals in the connectors which are located in the insertion stations 34. The wires are connected to the terminals by moving the connectors relatively upwardly towards the wires and moving insertion tooling means (not shown in FIGS. 3-5) downwardly towards the connectors until the wires are fully inserted to the terminals as shown in FIG. 2. Thereafter, a completed harness switch assembly 32*b*, FIG. 4, can be removed from the apparatus and the operating cycle repeated. At the end of each cycle, a connector will have been installed on the leading ends of the wires extending from the wire feed means. During each cycle, the manufacture of one harness is completed by the installation of a connector on the trailing ends of the cut wires, and the manufacture of another harness is started by the installation of a connector on the leading ends of the wires which extend from the reels and from the wire feed means 44.

Referring now to FIGS. 4 and 5, the apparatus embodiment of the invention comprises a support plate 50 beneath which there is provided a cam shaft 52 which is supported for rotation in suitable bearings 54 which are suspended from the underside of the plate 50 by mounting members 56. A stationary shaft 53 (FIG. 9) is provided beneath the frame plate 50 adjacent to the cam shaft 52 and serves as a pivotal axis or actuating levers for the several mechanisms as will be described below. The cam shaft is driven by a suitable motor and coupled to the motor by an electromagnetic clutch so that it can be rotated through a single revolution of each operating cycle.

The several mechanisms of the apparatus will now be described in detail under the individual headings set out below.

INSERTION STATIONS 34

Each insertion station has a connector holder 56 (FIG. 8) which is generally channel-shaped which has a stop 60 against which the connector 9 is moved so that it will be precisely located relative to the wires which have been fed through the connector and the insertion tool 78 described below. The connectors are fed to connector holder 56 along a feed track 58 by means of a feeding mechanism described below and the connector holder is supported on the upper end of a connector support slide 62. Slide 62 is mounted in suitable fixed gib or guide ways 64 which extend through the frame plate 50 so that slide 62 can be moved upwardly from the dotted line position of FIG. 8 to the solid line position thereof. The gibs 64 are secured to a suitable support bracket 66 which is, in turn, secured to the frame plate 50 and which extends upwardly from this plate as shown in FIG. 8.

Slide 62 has a pivotal connection 58 to a link 70 (FIG. 9) which extends beneath the frame plate 50 and which is pivoted at its lower end 69 to a lever 74. The lever extends rightwardly, as viewed in FIG. 9 and has its end 71 pivotally supported on the previously identified shaft 53. A cam roller 74 on the lever 72 is received in a cam track of a cam 76 which is keyed or otherwise secured to the shaft 52. The contour of the cam track is such that during each complete revolution of shaft 52, the connector support is raised to the solid line position of FIG. 8 to locate the connector which is held on the support in position for reception of the previously fed wires as will be described below.

The previously fed wires are engaged from above, as viewed in FIG. 8, and moved relatively into the wire receiving portions of the terminals by an insertion tool 78 which has depending insertion punches 80 on its lower end. The insertion tool 78 is secured to a vertically reciprocable insertion slide 82 which is slidably received between spaced apart gibs 84 on a forwardly extending portion 85 of the support plate 66. A link 88 is pivotally connected at 86 to the slide 82 and is pivoted at its upper end 89 to a lever 90. This lever is pivoted intermediate its ends at 92 to a bracket 93 extending from the bracket 66 and the other end of the lever is pivoted at 95 to a push rod 94. A cam roller 97 on the lower end of the push rod 94 is also received in a cam track in the cam 76 to cause upward movement of push rod 94 and, therefore, downward movement of rod 82 and insertion tool 78 concomitantly with upward movement of the support member 56. It will thus be apparent that the wires are not moved significantly when they are inserted into the wire receiving portions of the terminals but the connector is rather moved to the wires while the insertion tool moves downward to the wires and inserts them relatively into the connector. It should be mentioned that this wire insertion operation take place after actuation of the wire cutter which is described below.

The connectors are fed along the previously identified feed path 58 by a connector feed plunger 56 (FIG. 10) which is connected by a rigid coupling pin 98 to a block the end of a piston rod 100 of a piston cylinder 102 mounted beneath the frame plate 50. FIG. 10 shows the plunger 96 in its retracted position and during movement of the plunger towards its associated connector holder, it engages its lowermost connector 9 in a magazine 104 and delivers this connector to the connector holder. The magazine 104 has a guide channel 106 which holds a stack of connectors. Connectors are continuously supplied to the upper end of the magazine by a tape 108 having connectors mounted thereon in spaced apart relationship. The individual connectors 9 are held on the tape by integral bosses 110 on the tape which have a frictional fit within a recess extending inwardly from the rearward surface of a connector. The connector tape is supplied from a suitable reel and extends from this reel over a guide roller 111 mounted adjacent to the upper end 114 of the backwall 112 of the magazine 104. The upper end 114 of backwall 112 has notches to permit passage of the bosses 110 therethrough and the upper end of the magazine is such that the connectors are removed from the tape as the tape passes over the roller 111. The tape extends from the roller to a suitable wind-up mechanism which may be energized by a sensing switch in the magazine such that when the supply of connectors in the magazine falls below a given level, the wind up mechanism motor will be energized to advance the tape and replenish the stock of connectors in the magazine.

WIRE SHEAR 45

Referring specifically to FIGS. 12 and 13, the wire shearing mechanism comprises cooperable upper and lower normally open shearing plates 126, 132. The plates are contained in a housing 116 having housing plates 118, 120 which are secured to each other by spacer blocks 121 at their ends. The housing is mounted on the frame plate 50 between the two insertion stations 34, 34′ by means of brackets 122 and extends beneath the surface of the plate 50 as shown in FIG. 13. The plates 118, 120 have openings 123 through which the wires are fed.

The upper shear plate 126 is mounted on an upper shear slide 124 which is slidably contained in the housing and which is pivotally connected at its lower end by a pivot pin 128 to an actuating lever 130. This actuating lever is pivoted at 140 to an actuator rod 142 which closes the shearing plates as will be described below.

The lower shearing plate 132 is secured to a lower shear slide 134 which is also contained in the housing and which is pivoted at 136 to a second actuator lever 138. This second actuator lever is pivoted at its other end at 140 to the previously identified actuator rod 142. It will be apparent that the two levers 130. 138 constitute a toggle mechanism which is in its broken condition in FIG. 12. Upon rightward movement of the rod 142 from the position of FIG. 12, the toggle mechanism is partially straightened and the slide 124 is moved downwardly while the slide 134 is moved upwardly thereby moving the plates 126, 132 to the closed condition shown in FIG. 13.

As shown in FIG. 13, the slides are offset from each other in the housing and the central portions of the slides 124, 134 are cut out as shown for example, at 139 to permit straightening of the toggle mechanism. The housing plates 118, 120 are provided with horizontally extending slots 137 which receive rollers 135 mounted on the pivot pin 140. These slots 137 serve as guide slots and insure horizontal movement of the pivot pin 140 when the rod 142 is moved rightwardly.

The rod 142 is actuated during each operating cycle by a bell crank 146 (FIG. 9) having an upwardly extending arm 147 to which the rod 142 is pivotally connected at 144. The bell crank is pivotally mounted on the support shaft 153 and has a shorter arm 148 which extends inwardly and above the cam shaft 152. Arm 148 has a cam follower 150 on its end which is received in a cam track in a shear cam 152 which is keyed to the shaft 152.

WIRE FEED 44

The wire feed mechanism 44, FIG. 14 is mounted to the right of the insertion zone as viewed in FIG. 6 and comprises means for feeding each of the wires which extend from the reels selectively and simultaneously. Advantageously, this wire feed mechanism should also have the capability of feeding wires by different predetermined amounts. A suitable wire feed mechanism having these capabilities is disclosed in U.S. application Ser. No. 660,565 filed Feb. 23, 1976, now abandoned, which is hereby incorporated by reference.

The feed mechanism comprises a pair of spaced apart support plates 160 which are mounted on a slidable plate described below. The wires are guided from the spools or reels to the feed mechanism by a guide plate 183 which is supported between the support plates 160 and which extends leftwardly in FIG. 14 towards the insertion zone. The wires are fed over the upper surface 181 of the plate 183 and guided into the nips defined by a single driven feed roll 154 and a plurality of pressure rolls 156. As shown in FIG. 14, the support plate 183 has an opening 185 in the vicinity of the feed roll 154 so that the surface of this feed roll will engage the wires.

The feed roll 154 has a width such that it can receive the wires in side-by-side parallel relationship. The feed roll is keyed or otherwise secured to a shaft 158, which is journaled in the plates 160 and which extends to a flexible coupling 162 (FIG. 7) which in turn is coupled to the output shaft of low inertia motor 164, for example a printed circuit motor, mounted on the frame support plate 50. The flexible coupling 152 is provided in order to permit the entire feed mechanism to move horizontally from the position shown in FIG. 14 as will be described below. The coupling may be of any suitable type, for example, a type IEI 19-29-10 coupling manufactured by The Tool Gear & Pinion Company of 211 Township Avenue, Cincinnati, Ohio.

The individual pressure rolls 156 are each mounted on a lever 168 which comprises a pair of spaced apart strap members. Each lever 168 is pivotally mounted adjacent to its righthand end on a rod 170 which extends transversely between the side plates 160 so that the pressure rolls can be moved individually towards and away from the feed roll. The lefthand end of each lever 168 is connected by means of a yoke 172 to a piston rod 174 of a pneumatic piston cylinder 176. The piston cylinders 176 are advantageously of the double acting type and the piston rods 174 are normally retracted as shown in FIG. 14 so that the individual pressure rolls are maintained in spaced relationship to the feed rolls. Thus the wires will not be fed to the insertion zone unless the feed roll is rotating and the pressure rolls are moved downwardly from the position shown in FIG. 14. Such movement of the pressure rolls 156 to their feeding positions can be brought about by pressurizing the upper sides of the piston cylinders 176 and causing the levers 168 to swing through a slight counterclockwise arc. Since an individual piston cylinder is provided for each pressure roll, the wires can be selectively fed by pressurizing selected cylinders of the apparatus.

It is desirable to clamp the wires when they are not being fed and to this end, a clamping bar 180 is provided on each of the levers 168. Each clamping bar is secured by a fastener 179 to its respective lever on the righthand side of the pivotal axis 170. Each clamping bar extends downwardly towards the surface 181 and is dimensioned such that it will press the associated wire against the surface 181 when its associated feed roll 156 is in its raised or non feeding position. When the lever 168 is swung through a counterclockwise arc to move the pressure roll to its feeding position, the associated clamp immediately releases the wire.

As explained in application Ser. No. 660,565, a feeding means of this type can be operated to selectively feed the wires and to feed varying lengths of the individual wires. Application Ser. No. 660,565 completely describes the control circuit and programming means for this wire feeding mechanism so that this description need not be repeated here. The programming capabilities of this feeding system are, however, required for the practice of this invention, particularly where certain types of harnesses and subassemblies are being produced as will be described below.

As explained with reference to FIGS. 3–5, the wire feed mechanism as shown in FIG. 14, is moved rightwardly and away from the insertion zone during the operating cycle in order to position the ends of the cut wires which have been in alignment with the terminals in the connector. In this respect, the feed mechanism shown in FIG. 14 also serves as a wire clamp, the wires being clamped by the clamping bars 180 as explained above. The mechanism for retracting the feeding mechanism and moving it from the position of FIG. 4 to the position of FIG. 5, comprises a link or connecting rod 186 which is pivoted at its lefthand end to a slidable plate 182 on which the feeding mechanism is mounted. The slidable plate is slidably supported by suitable gibs on a fixed plate 184 on the surface of the frame plate 50. Link 186 is pivotally connected at 187 to the upper end of a lever 188 which extends downwardly and through a suitable opening in the frame plate 50. This lever is pivoted intermediate its ends as shown at 190 to a bracket which extends from the underside of the frame plate 50. A cam follower 194 on the lower end of the lever is received in a cam track 196 in a cam 198 which is keyed to the shaft 52. It will thus be apparent that during each revolution of the shaft 52, the entire mechanism will be moved for a short distance rightwardly to a retracted position and will then be returned to its initial position. When the feeding mechanism is in its retracted position, the ends of the wires extending from the feed mechanism will be directly over terminals in a connector which is positioned in the righthand insertion mechanism 34.

LEFTHAND JAW ASSEMBLY 48

Referring now to FIGS. 6, and 15–17, the lefthand jaw assembly 48 is located immediately to the left of the lefthand wire insertion station 34' and comprises clamping jaws for clamping the wires and support surfaces to support the wires while they are being fed through the insertion zone. The jaws are opened relatively widely during the wire-feeding portion of the cycle in order to provide clearance for the connector which is on the leading ends of the wires. This jaw assembly is also moved from a normal position to a retracted position in order to locate the wire ends over and, in alignment with, the terminals in the connector in the lefthand insertion station.

The upper and lower jaws 200, 202 are generally plate-like members and have a width as viewed in FIG. 17 which is in excess of the distance between the outside wires which are fed through the apparatus. Both jaws have extensions 204, 206 and the upper jaw extension 206 has a depending lip portion 207 which serves to clamp the wires in notches 208 (FIG. 16) in the lower jaw. The jaws are shown in their closed positions in FIGS. 15 and 16 and they move relatively away from each other to their open positions by mechanism which are described below.

The upper jaw 200 is secured to a vertically oriented mounting plate 210 which in turn, is secured to a vertically reciprocable support plate 214. This support plate has gibs 218 secured thereto for cooperation with gibs 216 on a horizontally movable plate 215 as shown best at FIG. 17 so that the plate 214 can move upwardly from the position shown in FIG. 15. Upward movement of the plate 214 is effected by a lever 220 which is pivotally connected at one end 221 to the plate 214. Lever 220 is pivoted imtermediate its ends to a block 223 which extends from a plate 215. The lefthand end 224 of the lever 220 is engaged by a roll pin 226 which is mounted in, and which extends from, a vertically movable bar 228 described in further detail below.

The lower jaw 202 is secured to, and extends from, a lower jaw support plate 229 which in turn is secured to a plate 230. Plate 230 is supported by gib means 232, 234 on the previously identified plate 215 so that the plate 230 can move downwardly to an open position. Plate 230 has a gusset plate 236 secured thereto to which the lower end of the control rod 228 is secrued at 237. The upper end of this jaw control rod 228 has an integral connecting block 242 extending from its lefthand side as viewed in FIG. 15 and the piston rod 240 of a piston cylinder 248 is coupled to this block. Piston cylinder 238 is mounted in a vertical orientation on the plate 215 so that when the piston rod 240 is moved downwardly from the position shown in FIG. 15, rod 228 will move downwardly and the lower jaw will be lowered from the position shown in FIG. 15. During such downward movement of rod 228, the roll pin 226 will engage the end 224 of lever 220 causing this lever to swing through a counterclockwise arc and raise the plate 214 and, therefore, raise the upper jaw 200.

A control arm 244 extends leftwardly from a block 242 and during downward movement of the piston rod 240. This control rod engages a roller 246 on a switch arm of a switch 248. This switch is secured to the end of a support member 250 which extends from a bracket 256.

As explained above, the plate 215 on which the jaws are mounted is movable horizontally leftwardly from the position shown in FIG. 15 so that after the wires have been severed, their cut ends can be positioned above a connector in the lefthand insertion station. This horizontal movement of the jaw mechanism is permitted by gib means 252, 254 on the plate 215 and on a fixed support plate 256 which is secured to the frame plate 50. The horizontal movement of the plate 215 is achieved by means of a lever 258 which extends through an opening in frame plate 50. This lever is pivotally connected at its upper end 260 to a connecting rod 262 which in turn is pivoted at 264 to a block 266 which is mounted on the plate 215. Lever 258 is pivoted intermediate its ends at 268 to a bracket 269 secured to frame plate 50 and has a cam follower 270 on its lower end which is received in a cam track 272 of a cam 274 on the cam shaft 52. The contour of the cam track is such that the jaw assembly will be retracted at the appropriate time in the operating cycle and then return to its stationary position.

It is desirable to provide a means for precisely locating the individual wires relative to each other immediately prior to clamping of the wires in the lefthand clamping jaw assembly 48. At this end, an aligning plate 276 is provided on the end of support plate 183 and has spaced apart notches therein so located that a wire positioned in each notch will be properly located relatively to adjacent wires in the alignment plate 276 extends laterally beyond the plate 183 and is coupled to the end of a piston rod 282 of a piston cylinder 284 which is secured or mounted beside the guide plate 183.

After the wires have been fed and prior to closing of the jaws 200, 202, the piston cylinder 284 is pressurized to cause leftward movement of the rod 282 so that the plate 276 moves through the insertion zone and comes to rest adjacent to the ends of the jaws 200, 202. When the plate is in this extended position, the wires will be precisely located relative to each other and when the jaws 200, 202 are closed, the wires will be located in the notches 208 on the lower jaw extension 204. The aligning plate then returns to its normal position against the lefthand end 278 of the plate 183 so that the wires being in the notches 280 are precisely located adjacent to the end of the plate 183. This aligning plate thus serves to precisely locate the wires so that they will be inserted into the wire receiving portions of the terminals in the connectors.

Upon completion of the operating cycle and after the jaws 200, 202 have been opened, the finished harness assembly is ejected from the apparatus by ejecting means comprising an ejector bar 286 on the end of a piston rod 288 of a piston cylinder 290. The piston cylinder is pressurized to cause movement of the slide and piston rod towards the front of the apparatus so that the completed harness subassembly is moved laterally from the apparatus as illustrated from FIG. 5. The piston-cylinder 290 is pressurized upon closing of the switch 248 when the jaws 200, 202 are opened.

The harness assembly shown in FIG. 1A has wires 4 extending between the terminals in the conductors which are all of the same size. Under some circumstances, it is desirable to produce a harness assembly as shown in FIG. 18, which has wires of increasing lengths extending between the two connectors. A harness assembly of this type is desirable where the assembly is being used on a flat surface and where the harness must be curved through an angle of up to 90°. The increasing links of the wires compensates for the differences in distances between corresponding terminals.

FIG. 19 shows a harness subassembly comprising a single connector having wires extending therefrom and an assembly of this type can be produced by simply immobilizing the lefthand insertion station of the apparatus. The wires in FIG. 19 may be of varying links if desired since the wire feed program can be established such that different wire links can be fed.

The disclosed apparatus is preferably provided with an electronic control system such as a computer, a micro-processor or a hard-wired logic system. In any event, the selective controls for this system are provided on the elevated control plant shown in FIG. 1. The wire feed control system disclosed in the above-identified application Ser. No. 660,565 is subservant to the overall control system which simply transmits a command to the wire feed system and which receives a signal from the system after the wires have been fed. The control system in addition then transmits signals which initiate the rotation of the main power shaft 52, the pressurization of the connector feeding cylinders 40, 40′ the cylinder for the aligning means or rake member shown in FIG. 14 and the harness ejector cylinder 290 (the switch 248 being provided as a backup safety feature). These cylinders can be controlled by conventional solenoid valves which respond to commands from control computer or its equivalent. It will be apparent that as an alternative, the operating cycle can be controlled by appropriately located switches arranged to be closed during the operating cycle such that the several mechanisms are operated in proper sequence. The computer or micro-processor is a preferred control method by virtue of its flexability small size, speed and because fewer moving parts are required. Furthermore, the need for fail-safe features (such as switches which sense the presence or absence of a particular part) is reduced.

What is claimed is:

1. Apparatus for manufacturing a multi-circuit electrical connecting means of the type comprising at least one multi-contact electrical connector having a plurality of contact terminals therein and wires connected to, and extending from, said terminals, said terminals having wire-receiving portions which are arranged in side-by-side parallel relationship in a row, said wires being received in said wire-receiving portions, said apparatus comprising:

a wire insertion zone, a wire feed means for feeding a plurality of wires from endless sources along a predetermined wire feed path which extends through, and beyond, said zone, said wire feed means comprising feed roll means and separate pressure roll means for each of said wires, feed roll means, feed roll motor means for rotating said feed roll means, said pressure roll means being in side-by-side spaced apart relationship and being normally spaced from said feed roll means, said pressure roll means and said feed roll means being on parallel spaced apart axes, connector holding and locating means for locating a connector on one side of said wire feed path with said wire receiving portions of said terminals in alignment with wires which have been fed along said wire feed path, wire inserter means in said insertion zone on the side of said wire feed path which is opposite to the side of said connector holding and locating means, said wire inserter means being normally spaced from said path and having means thereon for moving wires laterally of their axes and into said wire-receiving portions of terminals in a connector in said holding and locating means, wire feed control means comprising means for moving said pressure rolls relatively towards said feed roll means selectively and in unison, for starting and stopping said feed roll means, and for operating said feed roll means for a preselected time interval, and inserter actuating means for moving said inserter and a connector in said connector holding and locating means towards said path whereby, a predetermined length of each of said wires can be fed from said sources through said insertion zone by said wire feed means and said wires can thereafter be inserted, by said wire inserter means, into said wire-receiving portions of terminals in a connector in said holding and locating means.

2. Apparatus as set forth in claim 1, said apparatus having wire severing means in said insertion zone for severing said wires at a location adjacent to said connector holding and locating means.

3. Apparatus as set forth in claim 1, said apparatus having wire severing means in said insertion zone at a location adjacent to and downstream, relative to the direction of wire feed, from said connector holding and locating means.

4. Apparatus as set forth in claim 1, said apparatus having supporting and guide means adjacent to said insertion zone and upstream, relative to the direction of wire feed, from said zone, said wire feed means being supported on said supporting and guide means, said supporting and guide means having means for guiding said wires into and from said wire feed means in side-by-side parallel relationship.

5. Apparatus as set forth in claim 4, said wire feed means comprising a single wire feed roll having a width which is sufficient to receive said wires in side-by-side parallel relationship, said separate pressure roll means comprising a separate pressure roll for each of said wires, said wire feed control means comprising programmable means for starting and stopping said feed roll motor means and means for selectively moving said pressure rolls towards said single feed roll.

6. Apparatus as set forth in claim 1, said apparatus further comprising wire severing means in said insertion zone, said wire severing means being adjacent to said connector holding and locating means and spaced therefrom along said path, supporting and guide means adjacent to said insertion zone, and upstream, relative to the direction of wire feed, from said zone, said wire feed means being supported on said supporting and guide means, said supporting and guide means having means for guiding said wires into said insertion zone in side-by-side parallel relationship, said supporting and guide means being reciprocable in the direction of said path between first and second positions towards and away from said severing means, said supporting and guide means being relatively proximate to said severing means in said first position and being relatively remote from said severing means in said second position so that the ends of previously fed wires which have been cut by said severing means when said supporting guide means is in said first position are in alignment with said wire-receiving portions of said terminals in a connector in said connector holding and locating means when said supporting and guide means is in said second position.

7. Apparatus as set forth in claim 6, said severing means being disposed downstream, relative to the direction of wire feed along said path, from said connector holding and locating means.

8. Apparatus as set forth in claim 6, said inserter actuating means comprising means for moving said inserter and said connector holding and locating means towards each other whereby said wires are moved relatively into said wire-receiving portions when said inserter and said connector in said connector holding and locating means both arrive at said path.

9. Apparatus as set forth in claim 8 including connector feeding means for feeding connectors to said connector holding and locating means.

10. Apparatus for manufacturing electrical harness assemblies of the type comprising first and second electrical connectors and wires extending between said connectors, said connectors having a plurality of contact terminals therein, each of said terminals having wire-receiving portion which is adapted to receive a wire upon movement of said wire laterally of its axis and into said wire-receiving portion, said wire-receiving portions in each connector being arranged in side-by-side relationship in a row, the ends of said wires being received in said wire-receiving portions of said terminals, said apparatus comprising:

a wire insertion zone, wire feed means for feeding wires in side-by-side parallel relationship along a predetermined feed path which extends through said insertion zone, first and second connector holding and locating means for locating said connectors in side-by-side relationship in said zone, with said wire-receiving portions of said terminals in said connectors in alignment with wires which have been fed through said zone along said path, wire guide means for guiding said wires through said zone in side-by-side spaced-apart relationship with said wires in alignment with terminals in connectors in said connector holding and locating means, wire severing means between said first and second holding and locating means for severing wires which have been fed through said zone, first and second wire inserter means, said wire inserter means being on said path and on each side of said severing means and being effective to move wires extending along said path laterally of their axes and into said wire-receiving portions of contact terminals in connector in said first and second holding and locating means, first and second wire gripping means, said first wire gripping means being downstream, relative to the direction of wire feed along said path, from said first connector holding and locating means, said second wire gripping means being upstream from said second wire holding and locating means, both of said gripping means being normally open to permit feeding of said wires and being closable into gripping relationship with said wires, said first and second wire gripping means being movable in opposite directions along said wire feed path between inner and outer positions, said first and second gripping means being relatively proximate to said wire severing means when in said inner positions and being relatively remote from said severing means when in said outer positions, said gripping means being normally in said inner positions, said wire feed means comprising means for feeding said wires selectively by a predetermined amount whereby said apparatus has the capability of manufacturing a harness assembly in which the wires are of increasing length from one side of said harness to the other side thereof, and actuating means effective sequentially to actuate said feed means, to close said gripping means, to actuate said severing means to move said gripping means to said outer positions, and to thereafter actuate said inserter means.

11. Apparatus as set forth in claim 10 including connector feeding means for feeding connectors to said connector holding and locating means.

12. Apparatus for repetitively connecting a plurality of wires to a plurality of electrical terminals in an electrical connector housing or the like, each of said terminals having a wire-receiving portion which receives a wire upon relative movement of said wire laterally of its axis and into said wire-receiving portion, said wire-receiving portions being arranged in said housing in side-by-side relationship in a row, said apparatus comprising:

frame means, a wire insertion zone in said frame means, wire insertion means in said wire insertion zone, wire supporting and guide means adjacent to and upstream, relative to the direction of wire feed, from said insertion zone, said supporting and guide means comprising a plate-like member having a wire supporting and guiding surface, wire feed means for feeding a plurality of wires in side-by-side parallel co-planar relationship along a wire feed path which extends over said surface, and through and beyond said insertion zone, said feed means comprising a single driven feed roll and a pressure roll for each of said wires, said pressure rolls and said feed rolls being mounted on said supporting and guide means with said feed roll being on one side of said plate-like member and said pressure roll being on the other side thereof, motor means for rotating said feed roll, and means for selectively moving said pressure rolls towards and away from said feed roll selectively to feed selected wires of said plurality of wires whereby, during each operating cycle of said apparatus, a selected number of said wires are fed through said insertion zone and said selected wires are inserted into electrical terminals in a connector housing in said zone.

13. Apparatus as set forth in claim 12, said apparatus having means for feeding a succession of said electrical connector housings to said insertion zone.

14. Apparatus as set forth in claim 13, said apparatus having a second connector feeding and wire inserting assembly in said wire insertion zone whereby said wires can be connected to the wire-receiving portions of two connectors in said insertion zone.

* * * * *